US008668458B2

(12) United States Patent
Cho et al.

(10) Patent No.: US 8,668,458 B2
(45) Date of Patent: Mar. 11, 2014

(54) FAN AND VIBRATION-ABSORBING BOSS THEREOF

(75) Inventors: Min Gi Cho, Suwon-si (KR); Jin Baek Kim, Suwon-si (KR); Seong Ho Kil, Seongnam-si (KR); Young Jae Kim, Yongin-si (KR); Byung Ghun Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 299 days.

(21) Appl. No.: 13/067,662

(22) Filed: Jun. 17, 2011

(65) Prior Publication Data

US 2012/0027571 A1 Feb. 2, 2012

(30) Foreign Application Priority Data

Aug. 2, 2010 (KR) ..... 10-2010-0074763

(51) Int. Cl.
*F04D 29/34* (2006.01)

(52) U.S. Cl.
USPC ..... 416/204 R; 416/244 A; 416/500

(58) Field of Classification Search
USPC ..... 416/204 R, 500, 244 R, 244 B, 245 A, 416/244 A; 415/119
See application file for complete search history.

(56) References Cited

U.S. PATENT DOCUMENTS

| | | | | |
|---|---|---|---|---|
| 7,878,772 | B2 * | 2/2011 | Rexhauser et al. | 417/368 |
| 2011/0229341 | A1 * | 9/2011 | Andrejco et al. | 416/244 R |

FOREIGN PATENT DOCUMENTS

| | | | | |
|---|---|---|---|---|
| DE | 4317712 | C1 * | 12/1994 | H02K 9/06 |
| DE | 19905075 | A1 * | 8/2000 | F04D 29/28 |
| GB | 2382108 | A * | 5/2003 | F04D 29/66 |
| JP | 11-93895 | | 4/1999 | |
| JP | 2003-286997 | | 10/2003 | |
| KR | 20-0233977 | | 5/2001 | |
| KR | 10-2010-0030182 | | 3/2010 | |
| WO | WO 2010066540 | A1 * | 6/2010 | |

OTHER PUBLICATIONS

European Search Report issued Oct. 24, 2013 in corresponding European Application No. 11 17 2780.

* cited by examiner

*Primary Examiner* — Edward Look
*Assistant Examiner* — William Grigos
(74) *Attorney, Agent, or Firm* — Staas & Halsey LLP

(57) ABSTRACT

A fan including a hub part, a blade part and a vibration-absorbing boss, all constituent elements of which are injection molded, thereby reducing production costs. The fan has a minimized contact area between the vibration-absorbing boss and the hub part to prevent the vibration-absorbing boss from being deformed by high-temperature heat during insert injection molding of the hub part and the blade part while assuring sufficient strength of the hub part.

21 Claims, 6 Drawing Sheets

FAN AND VIBRATION-ABSORBING BOSS THEREOF

CROSS-REFERENCE TO RELATED APPLICATIONS

This application claims the benefit of Korean Patent Application No. 2010-0074763, filed on Aug. 2, 2010 in the Korean Intellectual Property Office, the disclosure of which is incorporated herein by reference.

BACKGROUND

1. Field

Embodiments relate to a fan having a vibration-absorbing boss, the fan being fabricated by insert injection molding.

2. Description of the Related Art

Fans serve to perform ventilation or heat dissipation via movement of air. Fans may be broadly classified into axial-flow fans or centrifugal fans and are used in air conditioners, refrigerators, cleaners and the like.

A fan includes a central cylindrical hub part, a blade part including a plurality of blades radially extending from the hub part, and a vibration-absorbing boss provided at the center of the hub part to firmly couple a rotating shaft of a motor to the fan while absorbing vibration due to rotation of the motor.

The vibration-absorbing boss includes a first boss member coupled to the rotating shaft of the motor, a second boss member coupled to the hub part, and a vibration-absorbing member connecting the first boss member and the second boss member to each other so as to absorb vibration. Generally, the first boss member and the second boss member are mainly formed by die-casting metal, such as aluminum or brass, and the vibration-absorbing member is formed of vulcanized rubber, such as Nitrile Butadiene Rubber (NBR) or Chloroprene Rubber (CR), for elasticity enhancement.

SUMMARY

Therefore, it is an aspect to provide a fan with a vibration-absorbing boss, all the components of which are fabricated by injection molding of a thermoplastic resin, thereby reducing production costs and simplifying a fabrication process as compared to a conventional vibration-absorbing boss consisting of first and second metal boss members and a vibration-absorbing member formed of vulcanized rubber.

Additional aspects will be set forth in part in the description which follows and, in part, will be apparent from the description, or may be learned by practice of the invention.

In accordance with one aspect, a fan includes a hub part, a blade part including a plurality of blades extending radially from the hub part and a vibration-absorbing boss provided at the hub part, wherein the vibration-boss includes a first boss member having a bore for insertion of a rotating shaft of a motor, a second boss member configured to surround the first boss member, the hub part being formed at an outer periphery of the second boss member, and a vibration-absorbing member provided between the first boss member and the second boss member to absorb vibration due to rotation of the motor, and wherein the second boss member includes a body portion coming into close contact with the vibration-absorbing member and a protruding portion configured to extend first radially from the body portion and then downward to define a groove around the body portion.

The second boss member may further include a flange portion extending radially from a distal end of the protruding portion.

The second boss member may further include a plurality of holes circumferentially arranged at a predetermined interval around the protruding portion, the holes penetrating the protruding portion to communicate the groove with the outside of the protruding portion.

The first and second boss members may be injection molded.

The vibration-absorbing member may be injection molded by inserting the first and second boss members.

The hub part and the blade part may be injection molded by inserting the vibration-absorbing member.

The first and second boss members may be made of polypropylene.

The vibration-absorbing member may be made of thermoplastic elastomer.

A resin may be charged into the groove of the vibration-absorbing boss upon insert injection molding of the hub part and the blade part to allow the vibration-absorbing boss and the hub part to be coupled to each other.

A resin may be charged around the flange portion of the vibration-absorbing boss upon insert injection molding of the hub part and the blade part to allow the vibration-absorbing boss and the hub part to be coupled to each other.

A resin may be charged into the holes of the vibration-absorbing boss upon insert injection molding of the hub part and the blade part to allow the vibration-absorbing boss and the hub part to be coupled to each other.

In accordance with another aspect, a vibration-absorbing boss, provided at a hub part of a fan while being coupled to a rotating shaft of a motor to absorb vibration due to rotation of the motor, includes a first boss member hiving a bore for insertion of the rotating shaft of the motor, a second boss member configured to surround the first boss member, the hub part being formed at an outer periphery of the second boss member, and a vibration-absorbing member provided between the first boss member and the second boss member to absorb vibration due to rotation of the motor, wherein the second boss member includes a body portion coming into close contact with the vibration-absorbing member and a protruding portion configured to extend first radially from the body portion and then downward and having a groove formed between the body portion and a downwardly extending portion thereof.

The second boss member may further include a flange portion extending radially from a distal end of the protruding portion.

The second boss member may further include a plurality of holes circumferentially arranged at a predetermined interval around the protruding portion, the holes penetrating the protruding portion to communicate the groove with the outside of the protruding portion.

The first and second boss members may be injection molded.

The vibration-absorbing member may be injection molded by inserting the first and second boss members.

The first and second boss members may be made of polypropylene.

The vibration-absorbing member may be made of thermoplastic elastomer.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
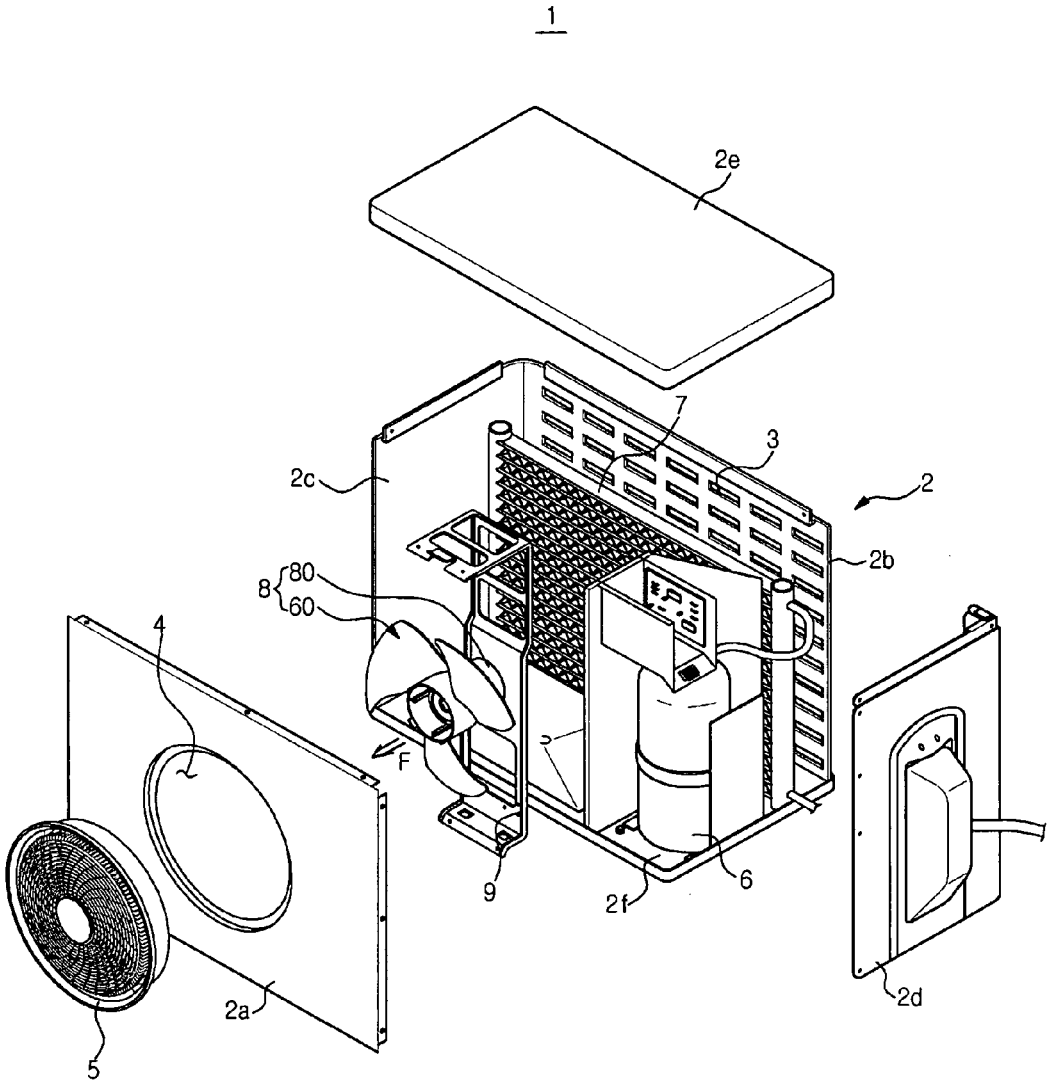
FIG. 1 is a view illustrating a fan mounted to an outdoor unit of an air conditioner according to an embodiment.

Reference will now be made in detail to the embodiments, examples of which are illustrated in the accompanying drawings, wherein like reference numerals refer to like elements throughout.

Figure 2:
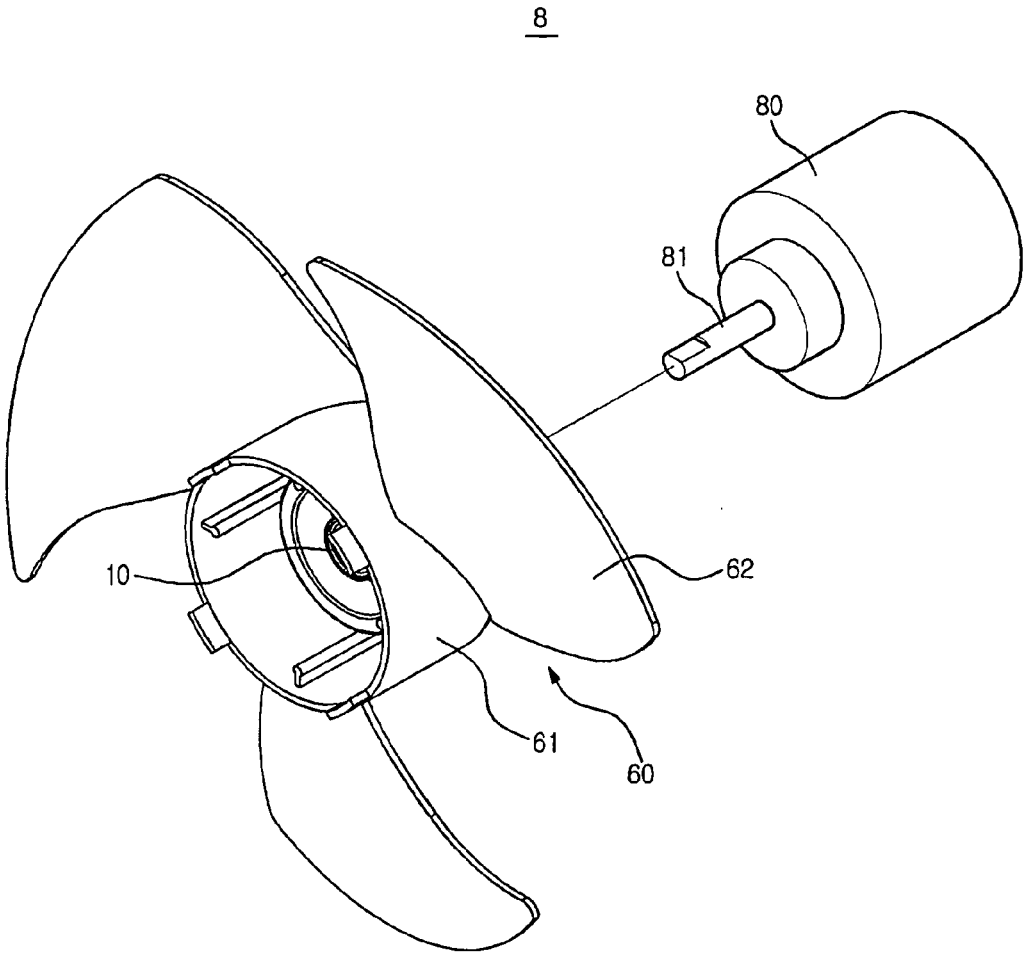
FIG. 2 is a view illustrating a blower including the fan according to the embodiment.
Figure 3:
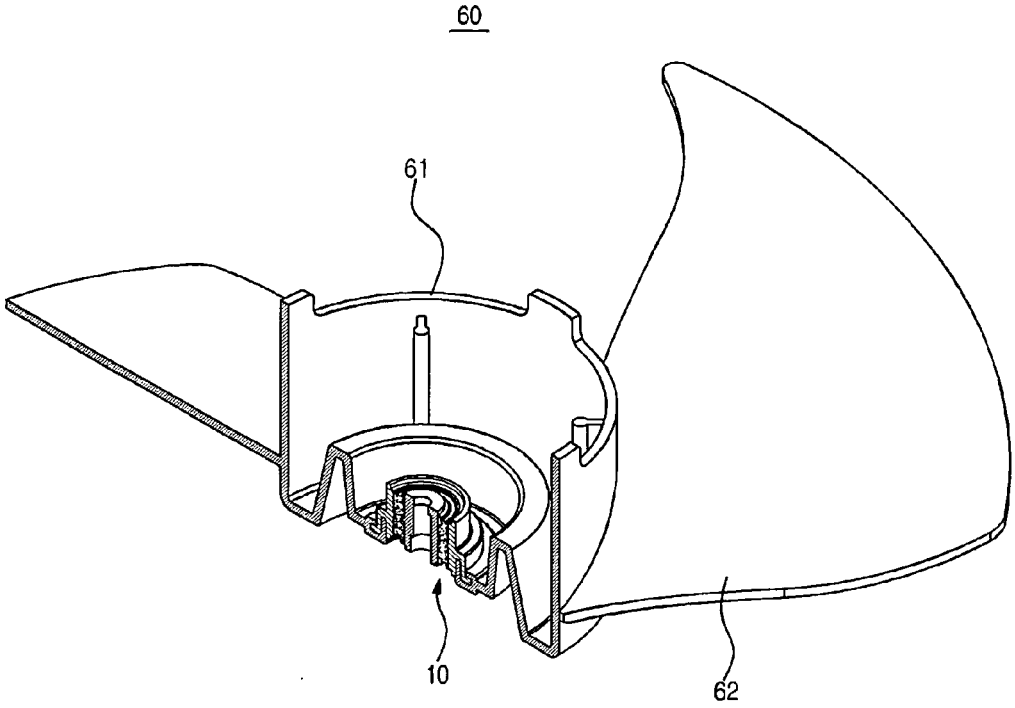
FIG. 3 is a sectional perspective view of the fan according to the embodiment.

FIG. 1 is a view illustrating a fan mounted to an outdoor unit of an air conditioner according to an embodiment, FIG. 2 is a view illustrating a blower including the fan according to the embodiment, and FIG. 3 is a sectional perspective view of the fan according to the embodiment.

An outdoor unit 1 of, e.g., an air conditioner, includes a front panel 2*a*, a rear panel 2*b*, two side panels 2*c* and 2*d*, a top panel 2*e* and a bottom panel 2*f*, which are assembled to define a box-shaped case 2.

The rear panel 2*b* is provided with intake holes 3 for intake of outside air, and the front panel 2*a* is provided with a discharge hole 4 for discharge of the interior air of the case 2.

A fan guard 5 is coupled to the discharge hole 4 and serves to prevent foreign substances from entering the outdoor unit 1.

A compressor 6, a heat exchanger 7 and a blower 8 are arranged in the case 2. The blower 8 includes a fan 60 and a motor 80 to drive the fan 60.

The blower 8 is secured by a supporting member 9, upper and lower ends of which are coupled to the top panel 2*e* and the bottom panel 2*f* respectively so as to be secured to the case 2.

The heat exchanger 7 is placed between the intake holes 3 and the fan 60 in a blowing direction F of the blower 8.

The outside air, suctioned through the intake holes 3, absorbs heat from the heat exchanger 7 thus serving to cool the refrigerant. Then, the air is discharged to the outside of the case 2 through the discharge hole 4.

The fan 60 includes a central cylindrical hub part 61, a blade part 62 including a plurality of blades radially extending from the hub part 61, and a vibration-absorbing boss 10 provided at the center of the hub part 61.

The vibration-absorbing boss 10 is coupled to a rotating shaft 81 of the motor 80 to transmit power to the fan 60 while absorbing vibration generated by rotation of the motor 80.

Figure 4:
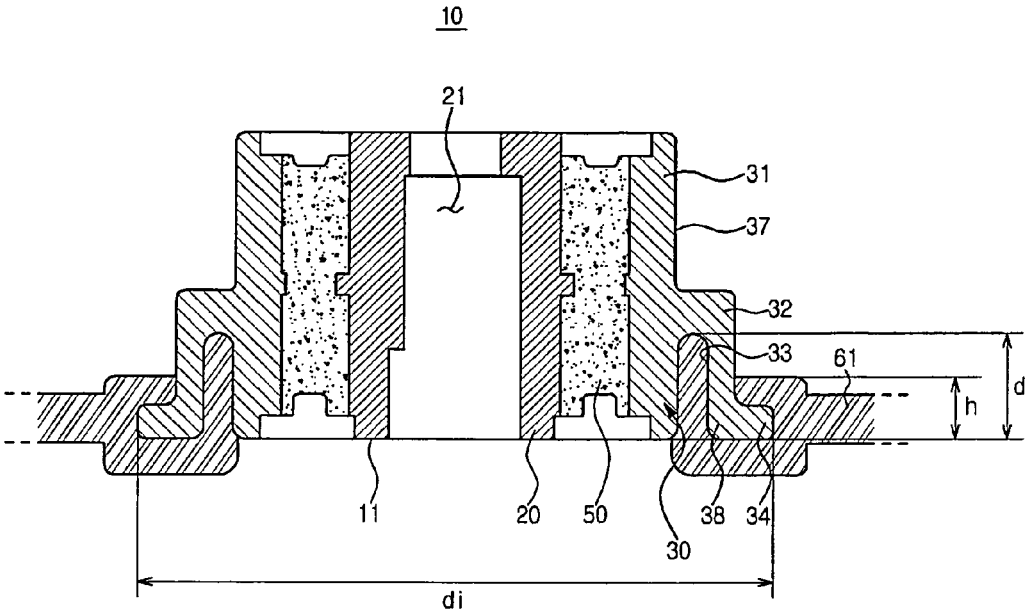
FIG. 4 is a cross-sectional view illustrating a vibration-absorbing boss and a hub part of the fan according to the embodiment.
Figure 5:
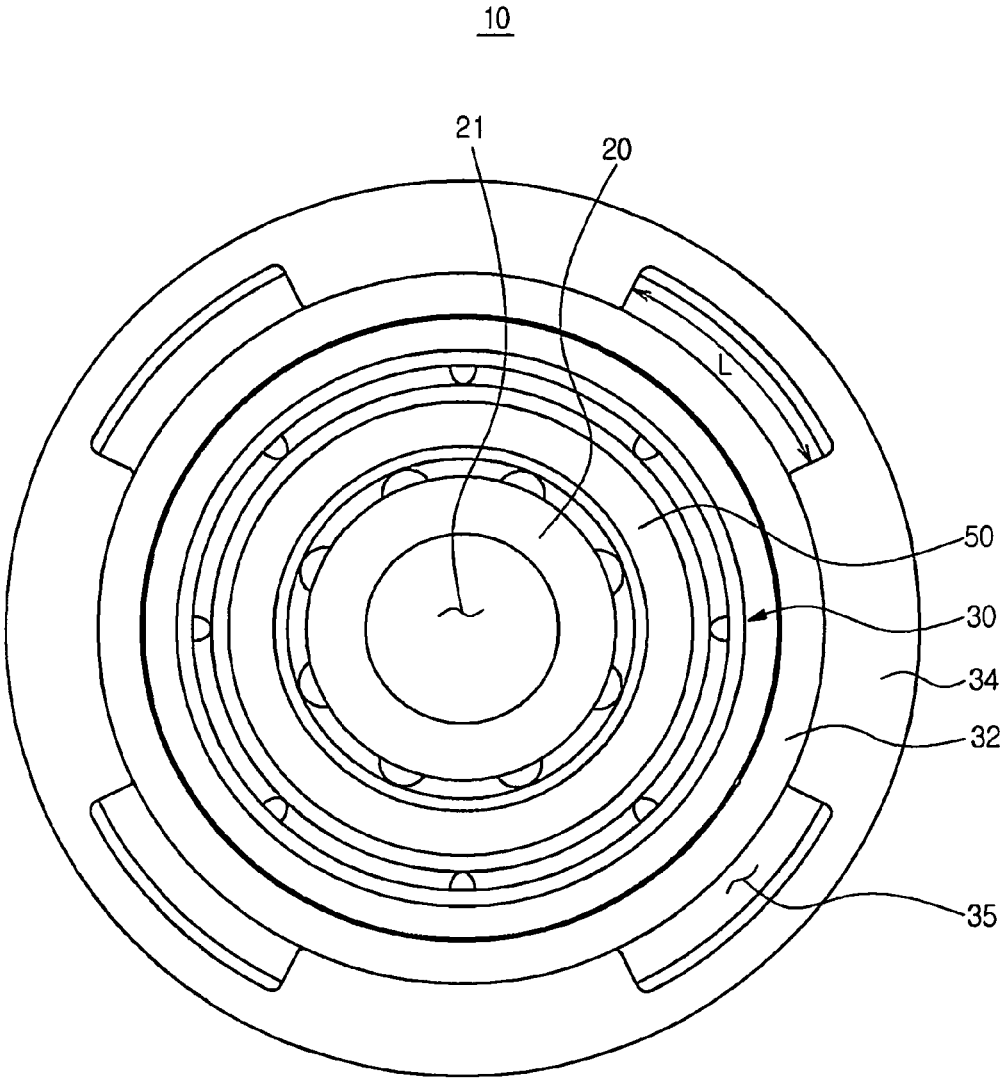
FIG. 5 is a plan view of the vibration-absorbing boss of the fan according to the embodiment.
Figure 6:
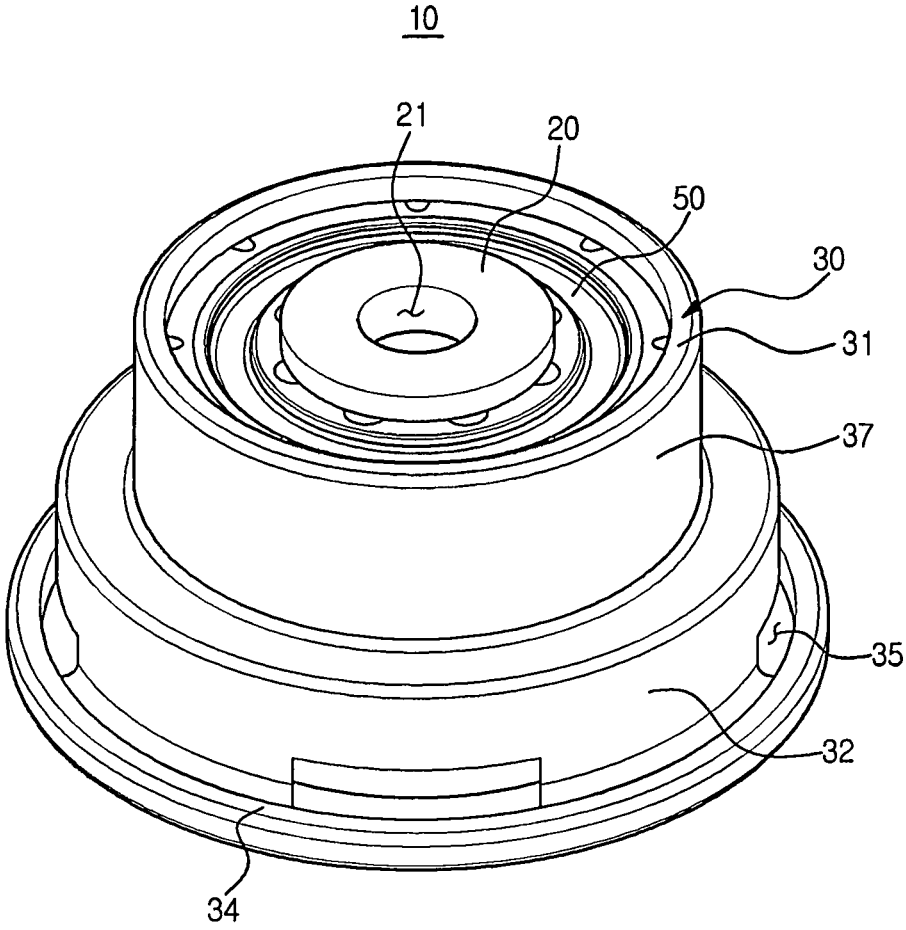
FIG. 6 is a perspective view of the vibration-absorbing boss of the fan according to the embodiment.

FIG. 4 is a cross-sectional view illustrating the vibration-absorbing boss and the hub part of the fan according to the embodiment, and FIGS. 5 and 6 are respectively a plan view and a perspective view of the vibration-absorbing boss of the fan according to the embodiment.

The vibration-absorbing boss 10 of the fan 60 according to the embodiment includes a first boss member 20, a second boss member 30 and a vibration-absorbing member 50.

The first boss member 20 has an approximately hollow cylinder shape and is provided with a bore 21 for insertion of the rotating shaft 81 of the motor 80.

The second boss member 30 is configured to surround the first boss member 20 and serves as a contact region between the hub part 61 and the vibration-absorbing boss 10 as the hub part 61 is injection molded around the second boss member 30 upon insert injection molding of the hub part 61 and the blade part 62.

The vibration-absorbing member 50 is provided between the first boss member 20 and the second boss member 30 to absorb vibration generated during rotation of the motor 80.

Thus, the entire vibration-absorbing boss 10 has a triple configuration in which the first boss member 20, the vibration-absorbing member 50 and the second boss member 30 are sequentially formed outward from the bore 21 perforated in the vibration boss 10.

The second boss member 30 of the vibration-absorbing boss 10 according to the embodiment includes a body portion 31 and a protruding portion 32 with a groove 33 around the body portion 31.

The body portion 31 defines the body of the second boss member 30 and comes into close contact at an inner peripheral surface thereof with the vibration-absorbing member 50.

The protruding portion 32 has an L-shaped form extending radially from a predetermined height of an outer peripheral surface 37 of the body portion 31.

Specifically, the protruding portion 32 first extends radially from the outer peripheral surface 37 of the body portion 31 at a height corresponding to 40-60% of the height of the vibration-absorbing boss 10 measured from a bottom surface 11 of the vibration-absorbing boss 10 and thereafter, is bent downward at a right angle so as to extend to the bottom surface 11 of the vibration-absorbing boss 10.

With the above-described configuration, the groove 33 having a predetermined depth from the bottom surface 11 of the vibration-absorbing boss 10 is formed around the body portion 31, i.e. between the body portion 31 and the protruding portion 32.

A resin is charged into the groove 33 upon insert injection molding of the hub part 61 and the blade part 62.

A flange portion 34 is formed at a distal end 38 of the protruding portion 32 to extend radially by a predetermined length.

The protruding portion 32 is circumferentially provided with a plurality of holes 35. The plurality of holes 35 is perforated in the protruding portion 32 at a predetermined interval to communicate the groove 33 with the outside of the protruding portion 32.

In the present embodiment, four to eight elongated holes 35 may be provided, and the length L of the holes 35 may be in a range of 10~30% of the diameter di of the bottom surface 11 of the vibration-absorbing boss 10.

To assure communication between the groove 33 and the outside of the protruding portion 32, the height h of the holes 35 from the bottom surface 11 may be less than the depth d of the groove 33 from the bottom surface 11.

A resin is charged into the holes 35 upon insert injection molding of the hub part 61 and the blade part 62.

That is, a resin is charged to fill the groove 33 tightly and surround the flange portion 34 upon insert injection molding of the hub part 61 and the blade part 62. In this case, the resin around the protruding portion 32 may have approximately the same height h as the depth d of the holes 35 from the bottom surface 11.

Thus, as the resin is tightly charged into the holes 35 formed at a predetermined interval around the protruding portion 32 upon insert injection molding of the hub part 61 and the blade part 62, the resin of the holes 35 may serve as hooks for coupling the hub part 61 to the second boss member 30.

With the above-described configuration, a contact area between the vibration-absorbing boss 10 and the hub part 61 may be minimized while still assuring sufficient bonding between the vibration-absorbing boss 10 and the hub part 61 and sufficient strength of the hub part 61 around the vibration-absorbing boss 10. In addition, it may be possible to prevent the vibration-absorbing boss 10 from being deformed by heat transferred from high-temperature resin during insert injection molding of the hub part 61 and the blade part 62.

Next, a method of fabricating the fan 60 will be described.

According to the embodiment of the present invention, first, the first and second boss members 20 and 30 of the vibration-absorbing boss 10 are injection molded individually.

The first and second boss members 20 and 30 may be made of a thermoplastic resin, such as polypropylene (PP), nylon (PA), acrylonitrile styrene (AS), and polycarbonate (PC).

Once the first and second boss members 20 and 30 are completed, the first and second boss members 20 and 30 are inserted into a mold for the vibration-absorbing member 50 to perform insert injection molding of the vibration-absorbing member 50.

Here, the vibration-absorbing member 50 may be made of thermoplastic elastomer.

With the insert injection molding of the vibration-absorbing member 50, the first boss member 20, the vibration-absorbing member 50 and the second boss member 30 are integrally formed with one another to complete the vibration-absorbing boss 10.

Next, the completed vibration-absorbing boss 10 is inserted into a mold for the hub part 61 and the blade part 62 and the resin is charged, enabling injection molding of the hub part 61 and the blade part 62.

The hub part 61 and the blade part 62 may be made of polypropylene (PP) similar to the first and second boss members 20 and 30.

With the insert injection molding of the hub part 61 and the blade part 62, the vibration-absorbing boss 10, the hub part 61 and the blade part 62 are integrally formed with one another to complete the fan 60.

As is apparent from the above description, in a fan according to the embodiment, it may be possible to form all constituent elements of the fan by injection molding while minimizing a contact area between a vibration-absorbing boss and a hub part, whereby the fan exhibits lower production costs and a simplified fabrication process as compared to conventional fans.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A fan comprising:

a hub part;

a blade part including a plurality of blades extending radially from the hub part and a vibration-absorbing boss provided at the hub part; and, wherein the vibration-boss includes a first boss member having a bore for insertion of a rotating shaft of a motor, a second boss member configured to surround the first boss member, the hub part being formed at an outer periphery of the second boss member, and a vibration-absorbing member provided between the first boss member and the second boss member to absorb vibration due to rotation of the motor, wherein the second boss member includes a body portion disposed adjacent to the vibration-absorbing member and a protruding portion configured to extend radially from the body portion and downward to define a groove around the body portion, wherein the first and second boss members are injection molded with a plastic material, wherein the vibration-absorbing member is injection molded between the first boss member and the second boss member with a thermoplastic elastomer, and wherein a portion of the hub part and the blade part are injection molded by inserting the vibration-absorbing member.

2. The fan according to claim 1, wherein the second boss member further includes a flange portion extending radially from a distal end of the protruding portion.

3. The fan according to claim 1, wherein the second boss member further includes a plurality of holes circumferentially arranged at a predetermined interval around the protruding portion, the holes penetrating the protruding portion to communicate the groove with the outside of the protruding portion.

4. The fan according to claim 1, wherein the first and second boss members are made of polypropylene.

5. The fan according to claim 1, wherein the vibration-absorbing member is made of thermoplastic elastomer.

6. The fan according to claim 1, wherein the hub part is charged into the groove of the vibration-absorbing boss upon insert injection molding of the fan such that the vibration-absorbing boss and the hub part are coupled to each other.

7. The fan according to claim 2, wherein the hub part is charged around the flange portion of the vibration-absorbing boss upon insert injection molding of the fan such that the vibration-absorbing boss and the hub part are coupled to each other.

8. The fan according to claim 3, wherein the hub part is charged into the holes of the vibration-absorbing boss upon insert injection molding of the fan such that the vibration-absorbing boss and the hub part are coupled to each other.

9. A vibration-absorbing boss provided at a hub part of a fan while being coupled to a rotating shaft of a motor to absorb vibration due to rotation of the motor, the vibration-boss comprising:

a first boss member having a bore for insertion of the rotating shaft of the motor;

a second boss member configured to surround the first boss member, the hub part being formed at an outer periphery of the second boss member; and a vibration-absorbing member provided between the first boss member and the second boss member to absorb vibration due to rotation of the motor, wherein the second boss member includes a body portion disposed adjacent to the vibration-absorbing member and a protruding portion configured to extend radially from the body portion and downward to define a groove around the body portion, wherein the first and second boss members are injection molded with a plastic material, wherein the vibration-absorbing member is injection molded between the first boss member and the second boss member with a thermoplastic elastomer, wherein a portion of the hub part fills the groove of the second boss member.

10. The vibration-absorbing boss according to claim 9, wherein the second boss member further includes a flange portion extending radially from a distal end of the protruding portion.

11. The vibration-absorbing boss according to claim 9, wherein the second boss member further includes a plurality of holes circumferentially arranged at a predetermined interval around the protruding portion, the holes penetrating the protruding portion to communicate the groove with the outside of the protruding portion.

12. The vibration-absorbing boss according to claim 9, wherein the first and second boss members are made of polypropylene.

13. The vibration-absorbing boss according to claim 9, wherein the vibration-absorbing member is made of thermoplastic elastomer.

14. An air conditioner comprising:

an air discharging unit including a fan and a motor to drive the fan, the fan comprising a hub part, a blade part including a plurality of blades extending radially from the hub part, and a vibration-absorbing boss provided at the hub part, the vibration-absorbing boss including a first boss member having a bore for insertion of a rotating shaft of a motor, a second boss member configured to surround the first boss member, and a vibration-absorbing member provided between the first boss member and the second boss member to absorb vibration due to rotation of the motor, wherein the second boss member includes a body portion disposed adjacent to the vibration-absorbing member and a protruding portion configured to extend radially from the body portion and downward to define a groove around the body portion, and wherein the second boss member is made of thermoplastic material, and the hub part is integrally formed with the vibration-absorbing boss such that the hub part is in contact less than 60% of height of the second boss member.

15. The air conditioner according to claim 14, wherein the hub part is integrally formed with the vibration-absorbing boss at the protruding portion of the second boss member.

16. The air conditioner according to claim 14, wherein the vibration-absorbing boss is inserted into a mold to perform injection molding to form the blade part and the hub part around the vibration-absorbing boss.

17. The air conditioner according to claim 14, wherein the first and second boss members are injection molded plastic pieces which are inserted into a mold to perform injection molding of the vibration-absorbing member between the first and second boss members.

18. The air conditioner according to claim 14, wherein the vibration-absorbing member is made of thermoplastic elastomer.

19. The air conditioner according to claim 15, wherein the protruding portion extends radially from the body portion at a height corresponding to 40-60% of the height of the second boss member.

20. The air conditioner according to claim 15, wherein a portion of the hub part fills the groove of the second boss member.

21. An air conditioner comprising:

an evaporator;

a compressor;

a condenser; and the fan of claim 1.

* * * * *